US007956814B2

(12) United States Patent
Reinheimer et al.

(10) Patent No.: US 7,956,814 B2
(45) Date of Patent: Jun. 7, 2011

(54) ARRANGEMENT OF AN ANTENNA ON A CONTAINER

(75) Inventors: Hans-Joerg Reinheimer, Wettenberg (DE); Knut Buchweitz, Jena (DE); Jakob Heierli, Reute (CH)

(73) Assignee: REEL Reinheimer Elektronik GmbH, Wettenberg (DE)

( * ) Notice: Subject to any disclaimer, the term of this patent is extended or adjusted under 35 U.S.C. 154(b) by 368 days.

(21) Appl. No.: 12/323,035

(22) Filed: Nov. 25, 2008

(65) Prior Publication Data

US 2009/0073077 A1 Mar. 19, 2009

Related U.S. Application Data

(63) Continuation of application No. PCT/DE2007/000846, filed on May 10, 2007.

(30) Foreign Application Priority Data

May 29, 2006 (DE) ..... 10 2006 025 214

(51) Int. Cl.
*H01Q 1/32* (2006.01)
*H01Q 1/42* (2006.01)

(52) U.S. Cl. ..... 343/713; 343/872

(58) Field of Classification Search ..... 343/711, 343/713, 872, 895, 900
See application file for complete search history.

(56) References Cited

U.S. PATENT DOCUMENTS

| | | | | |
|---|---|---|---|---|
| 5,565,858 | A * | 10/1996 | Guthrie | 340/10.33 |
| 6,753,775 | B2 * | 6/2004 | Auerbach et al. | 340/539.22 |
| 7,828,346 | B2 * | 11/2010 | Terry et al. | 292/327 |
| 2004/0041705 | A1 | 3/2004 | Auerbach et al. | |
| 2004/0066328 | A1 | 4/2004 | Galley, III et al. | |
| 2005/0252259 | A1 | 11/2005 | Ekstrom | |
| 2007/0075075 | A1 | 4/2007 | Jaeger et al. | |

FOREIGN PATENT DOCUMENTS

| | | | |
|---|---|---|---|
| GB | 2 359 208 | A | 8/2001 |
| WO | WO 2004/021299 | A1 | 3/2004 |
| WO | WO 2007/040748 | A1 | 4/2007 |

OTHER PUBLICATIONS

Translation of the International Preliminary Report on Patentability dated Jan. 20, 2009.
International Search Report dated Oct. 19, 2007 (Three (3) pages).

* cited by examiner

*Primary Examiner* — Shih-Chao Chen
(74) *Attorney, Agent, or Firm* — Crowell & Moring LLP

(57) ABSTRACT

An antenna carrier (10) with an antenna (14) for electromagnetic radiation to be fastened to a wall (1) of a container composed of steel plate and having ventilation openings (5) which are covered on the exterior side of the container wall (1) by a cover (3) which protects against sprayed water, and which forms a cavity (6) in front of the ventilation openings (5), in which the cover (3) is composed of plastic, the antenna (14) projects through a ventilation opening (5) into the cavity (6) formed by the cover, the antenna carrier (10) is fastened on the interior side (9) of the container wall (1), and the antenna carrier (10) is the ground reference surface of the antenna (14) and is constructed as a magnetizable metal plate (11).

15 Claims, 2 Drawing Sheets

ARRANGEMENT OF AN ANTENNA ON A CONTAINER

CROSS REFERENCE TO RELATED APPLICATIONS

This application is a continuation of international patent application no. PCT/DE2007/000846, filed May 10, 2007 designating the United States of America and published in German on Dec. 6, 2007 as WO 2007/137551, the entire disclosure of which is incorporated herein by reference. Priority is claimed based on Federal Republic of Germany patent application no. DE 10 2006 025 214.4, filed May 29, 2006.

BACKGROUND OF THE INVENTION

The present invention relates to an antenna carrier with an antenna for electromagnetic radiation to be fastened on a wall of a container made of steel plate and having ventilation openings which are covered on the exterior side of the container wall by a cover which protects against sprayed water, with the cover forming a cavity in front of the ventilation openings.

Containers comprised of steel plate are typical for the worldwide transport of semifinished and finished products. The containers have closable doors on a front side, which may also be separately secured. The walls of the containers are typically trapezoidally profiled for stabilization. The dimensions of the containers are extensively standardized. The containers are stackable for ship transport, the stacks being lockable to one another. For rail and truck transport, the respective containers are usually loaded individually.

To control the material flow of semifinished products and also finished products, it is necessary to be able to track the transport path and the particular location of the containers. In addition, expensive container contents must possibly be monitored against theft or manipulation of the products. The most continuous possible monitoring and/or report upon break-in of a container are desirable.

Determining the location of a container via GPS (global positioning system) and reporting it via GSM (global system for mobile communication), for example, are known. The location report may also contain information about unauthorized opening of the container.

Electronic systems for location determination and reporting may be constructed in a robust and largely maintenance-free and low-power design, so that they remain ready for use over a long period of time when equipped with modern batteries. A requirement for their verification function is that they are affixed to the container so as to be secure against manipulation, destruction, or loss. In addition, they need to be easily and rapidly replaceable in case of maintenance. The systems have suitable antennas for signal reception and signal transmission.

Known systems for location determination and monitoring of the containers are designed as flat closed boxes having internal antennas. These boxes are externally fastened in suitable recesses on the container. Sensors, which detect an unauthorized opening of the door, may be associated with the doors of the container. Other known systems are fastened to the interior side of the door with their antennas being guided out through sealing lips of the door panels and/or installed therein.

An arrangement is known from US 2004/0066328 A1, in which transmitter electronics having an antenna are provided in a replaceable box. The box is placed outside the container in the lock area of the container doors mechanically secured on a locking bar for the container doors. A door opening sensor is extended through a door gap into the container interior and connected to security electronics in the box.

Another arrangement is known from WO 2004/021299 A1, in which an antenna arrangement is fastened on the exterior container wall in an inward facing trapezoidal area and provided with a plastic cover so it is flush with the surface.

It is known from US 2007/075075 A1 to situate transceiver electronics inside a container and extend the connecting line to the antenna outside of the container interior through an existing ventilation opening in the container wall. The antenna may be situated inside a cap covering the ventilation openings and connected to the cap.

Systems attached to the exterior walls of the containers may be damaged during loading and stacking of the containers. In addition, the outside location may not reliably prevent an unauthorized intervention for manipulation of the system. Internal systems require an antenna to extend outside the container in any case because the container walls form a nearly perfect shield for electromagnetic radiation. The antennas extending between sealing lips of the door panels may be damaged on their external ends when the doors are closed, and are subject to additional strains when the door panels are moved.

SUMMARY OF THE INVENTION

It is therefore an object of the invention to provide an antenna arrangement for a steel container which is protected against damage and unauthorized outside manipulation.

Another object of the invention is to provide an antenna arrangement for a steel container which assures reliable communication between the exterior world and electronic systems arranged in the interior of the container for determining the container location and monitoring the container content.

A further object of the invention is to provide an antenna arrangement for a steel container which may be retrofitted and/or exchanged in a simple manner.

These and other objects are achieved in accordance with the present invention by providing an antenna arrangement as described above in which the cover for the ventilation openings is comprised of synthetic resin material (plastic), the antenna projects through a ventilation opening into a cavity defined by the cover, the antenna carrier is secured to the interior side of the container wall, and the antenna carrier constitutes the ground reference surface of the antenna and is constructed as a magnetizable metal plate. Advantageous further preferred embodiments will become apparent from the following description and claims.

The invention makes use of the fact that standardized containers are each provided on at least one side wall with ventilation openings, which facilitate a temperature-related pressure equalization of the container volume with the exterior environment. The ventilation openings typically comprise a pattern of holes having a diameter of approximately 8 mm. A nonremovable cover which protects against water spray is placed externally over this pattern. The cover forms a closed cavity in front of the hole pattern, which is protected on the bottom against penetration of water spray by webs arranged offset in height and location relative to one another. The cover is provided with slots for the air entry underneath. The cover is inserted into an inwardly pointing profiled segment of the container wall, so that it is protected against impacts during loading. The cavity in front of the ventilation openings has a height of approximately 2.5 cm.

Surprisingly, it has been found that the existing cavity in front of the ventilation openings is sufficient, with appropriate construction and arrangement of the antenna carrier and the antenna shape, to be able to send or receive a transmission between the interior of the container and the outside. It is only necessary to ensure that the cover is comprised of plastic. The closing of individual ventilation openings by the antenna arrangement does not affect the necessary pressure equalization.

BRIEF DESCRIPTION OF THE DRAWINGS

The invention will be described in further detail hereinafter with reference to an illustrative preferred embodiment of the antenna arrangement according to the invention which is depicted schematically in the accompanying drawing figures, wherein.

DETAILED DESCRIPTION OF PREFERRED EMBODIMENTS

Figure 1:
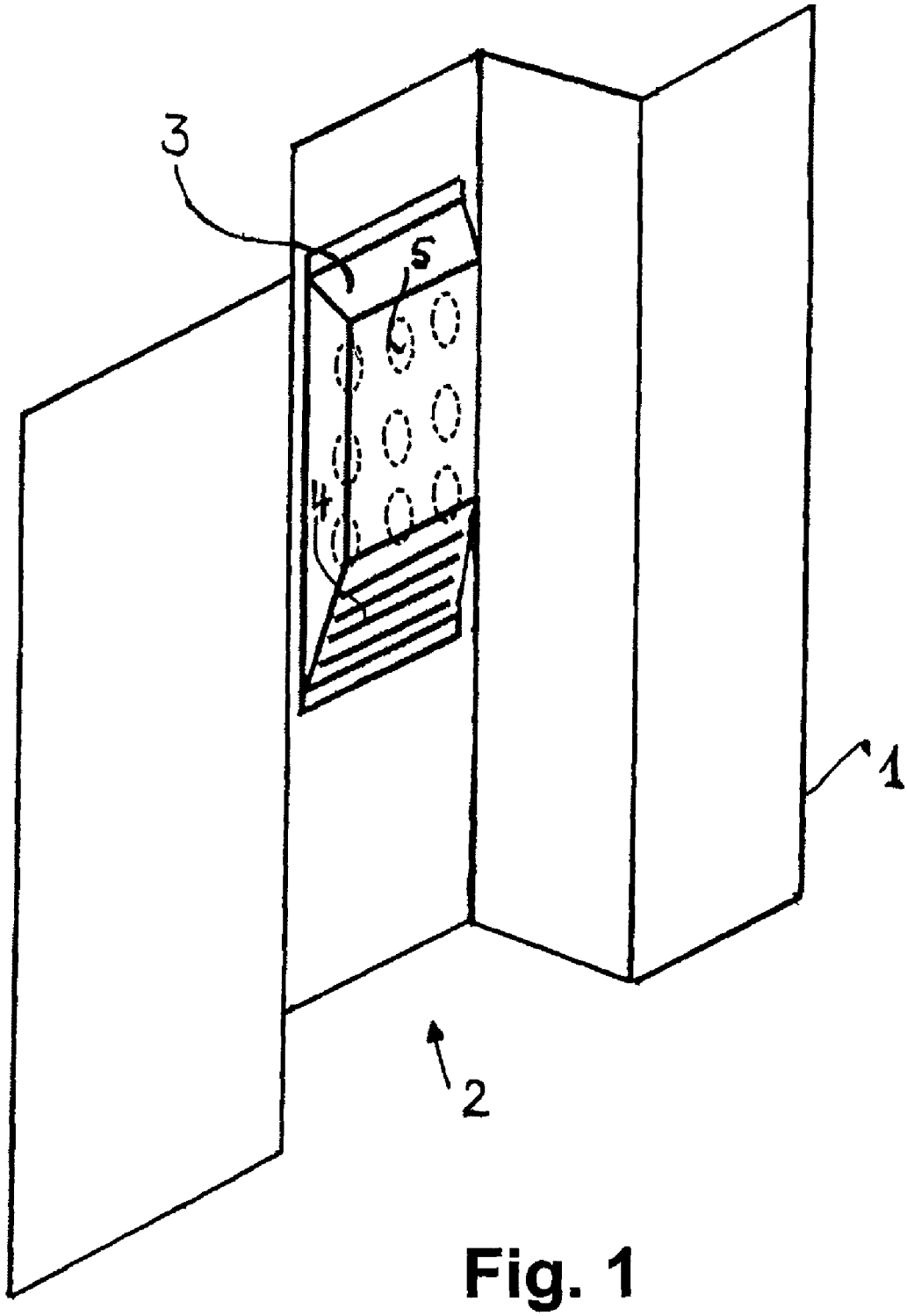
FIG. 1 is a partial exterior view of a container provided with a cover for ventilation openings.

FIG. 1 shows a detail of a trapezoidally profiled container wall 1 viewed from the outside. A cover 3 is inserted in an inwardly facing profile segment 2 of the container wall 1. The cover 3 is connected permanently to the container wall 1 by fasteners (not shown in greater detail). Slots 4 are arranged in the lower area of the cover 3 as air passages. A pattern of ventilation openings 5, which are protected by the cover 3, is depicted in the upper area.

Figure 2:
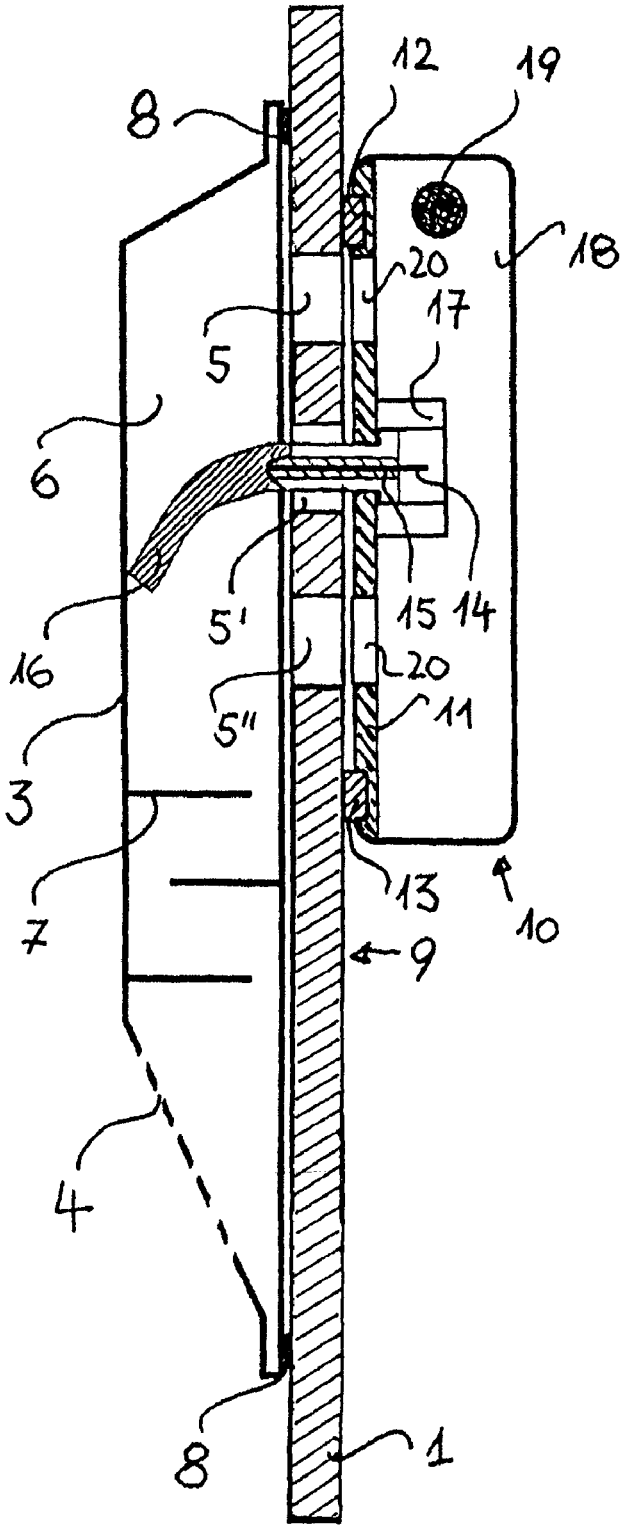
FIG. 2 is a cross-sectional view through the container wall provided with an antenna arrangement according to the present invention.

FIG. 2 shows a cross-section through the container wall 1 in the area of the cover 3. Three ventilation openings 5, 5', 5" from the pattern depicted in FIG. 1, which lie one underneath another, are shown in the container wall 1. The cover 3 forms a cavity 6 in front of the ventilation openings 5, 5', 5". Three webs 7, which are arranged offset in height and laterally relative to one another, are provided below the cavity 6. These staggered webs 7 serve to prevent sprayed water from entering the cavity 6 through the slots 4. The cover 3 is also protected by a circumferential seal 8 against the penetration of water or dust. The seal 8 may alternatively be formed by a bead of suitable adhesive for fastening the cover 3 to the container wall 1.

An antenna carrier 10 is situated on the interior side 9 of the container wall 1. The antenna carrier 10 is formed by a magnetizable metal plate 11, which is provided with permanent magnetic surfaces 12, 13. The magnetic surfaces 12, 13 are used to adhere the antenna carrier 10 to the container wall 1. In practice, the metal plate 11 should press against the container wall 1 with as much planar contact as possible. The air spacing shown in FIG. 2 is depicted only to more clearly illustrate the parts of the antenna arrangement. In addition, it is thus indicated that in reality an ideal planar contact may not be achieved due to an uneven paint application on the container wall 1 or other irregularities, unless the attachment surface is machined flat beforehand.

An antenna 14 is fastened to the metal plate 11 in such a way that it extends through an opening in the metal plate 11. The antenna 14 is enclosed in a line area in a known manner by a dielectric sheath 15 and otherwise by an abrasion-resistant protective cover 16. The protective cover 16 is also used so that the antenna 14 is not damaged upon insertion into one of the ventilation openings 5, 5', 5". In addition, a plastic ring may be inserted into the ventilation opening to protect the antenna.

A plug terminal 17, which is conventional per se and which has electrical contact to the metal plate 11, is provided around the antenna 14 on the metal plate 11. The metal plate 11 thus forms the ground reference surface for the antenna 14. The connecting cable to be attached to the plug terminal 16 from the antenna 14 to the transceiver electronics is not shown.

The metal plate 11 is angled perpendicularly to the container wall 1 on one longitudinal side to form a flange 18. A handle 19 is fastened on this flange 18 parallel to the container wall 1. The handle 19 is used to lift the antenna carrier 10 off the container wall 1. Other possible grip embodiments for lifting the magnetically adhering metal plate 11 off the container wall 1 are within the skill of the art.

To situate the antenna carrier 10 having the antenna 14 fastened thereon on the container wall 1, the antenna end provided with the protective envelope 16 is pushed through one of the ventilation openings 5' and extended into the cavity 6. The length of the antenna 14 to be inserted into the cavity 6 is a function of the transmission frequency. For a predefined height of the cover 3 in the area of the cavity 6, it is therefore advantageous if the antenna 14 has a flexible construction, so that longer antennas 14 may also bend and slide along the cover 3 when they encounter it. Rod and helical antennas are particularly suitable as flexible antenna shapes, which may also be provided with a slight curvature before their insertion into the cavity 6. Of course, other antenna shapes, e.g., chip antennas, tuned to other transmission frequencies may also be used, if they can be inserted through one of the ventilation openings 5 into the cavity 6.

In the frequency ranges used for GPS and GSM, a helical antenna is essentially a rod antenna shortened by coiling. The total length of the coiled wire acts as a lambda/4 antenna. The antenna may be tuned to two resonant frequencies, at which it may be adjusted to 50 ohm antenna resistance, by the effective length of the helix in connection with an extended part as a rod antenna between the base point and the beginning of the helix. However, it is simpler in application to provide separate antenna carriers for different frequencies.

A minimum area, which is easy to ascertain by experiments, is to be provided for the function of the metal plate 11 as the ground reference surface. It may thereby result that when the metal plate 11 is attached to the container wall 1, it will cover further ventilation openings 5, 5" in addition to the ventilation opening 5' used for inserting the antenna into the cavity 6. If this causes any interference with the pressure equalization for the container interior, the metal plate 11 may be provided with a hole pattern 20 matching the pattern of the ventilation openings 5, 5', 5".

Instead of the magnetic adhesion of the antenna carrier 10 on the container wall 1, a mechanical fastening in the form of a spreading device may also be provided, which is fastened on the metal plate 11 in such a way that it engages in a further ventilation opening upon insertion of an antenna in one of the ventilation openings and may be locked therein, for example, via a lever mechanism. If the metal plate 11 has additional holes 20, a separate spreading element may also be provided extending through registering holes in the metal plate 11 and in the container wall 1 to fasten the antenna carrier 10 to the container.

The described antenna carrier 10 represents a robust component which may be adapted in its dimensions in manifold ways to the conditions defined by the ventilation openings.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

The invention claimed is:

1. An antenna carrier with an antenna for electromagnetic radiation to be fastened to a wall of a container comprised of steel plate and having ventilation openings, wherein the ventilation openings are covered on the exterior of the container wall by a cover comprised of synthetic resin material which protects against sprayed water and which forms a cavity in front of the ventilation openings;

the antenna projects through a ventilation opening into the cavity formed by the cover;

the antenna carrier is secured on the interior side of the container wall; and the antenna carrier is the ground reference plane of the antenna and is constructed as a magnetizable metal plate.

2. An antenna carrier as claimed in claim 1, wherein the metal plate rests against the container wall in substantially planar contact with the wall.

3. An antenna carrier as claimed in claim 1, wherein the metal plate is provided with permanent magnetic surfaces for adhering the metal plate to the container wall.

4. An antenna carrier as claimed in claim 3, wherein the magnetic surfaces are constructed having opposite poles.

5. An antenna carrier as claimed in claim 3, wherein the metal plate is provided with a handle to facilitate detaching the magnetically adhered plate from the container wall.

6. An antenna carrier as claimed in claim 1, wherein the metal plate is provided with a removable spreading device, which is insertable into one of the ventilation openings.

7. An antenna carrier as claimed in claim 1, wherein the metal plate has a hole pattern matching the arrangement of the ventilation openings.

8. An antenna carrier as claimed in claim 7, wherein the antenna is inserted into one of the holes of the metal plate hole pattern.

9. An antenna carrier as claimed in claim 8, wherein at least the hole of the hole pattern in which the antenna is inserted is provided with a plastic border which engages in the matching ventilation opening.

10. An antenna carrier as claimed in claim 7, wherein a spreading device, which is insertable into a hole of the hole pattern and the matching ventilation opening, is provided for fastening the metal plate to the container wall.

11. An antenna carrier as claimed in claim 1, wherein the antenna comprises a flexible rod antenna.

12. An antenna carrier as claimed in claim 1, wherein the antenna comprises a flexible helical antenna.

13. An antenna carrier as claim in claim 12, wherein the antenna comprises a combination of helical and rod antennas designed for two different resonant frequencies.

14. An antenna carrier as claimed in claim 1, wherein the antenna is provided with an abrasion-resistant protective envelope.

15. An antenna carrier as claimed in claim 1, wherein multiple antennas, which are tuned to different frequencies, are fastened on separate metal plates.

* * * * *